US005657555A

United States Patent [19]

Milojevic et al.

[11] Patent Number: 5,657,555

[45] Date of Patent: Aug. 19, 1997

[54] PROCESS AND HOT-AIR DRYER FOR DYING COATED SURFACES

[75] Inventors: Dragoslav Milojevic, Butzbach; Manfred Lösch, Frankfurt am Main, both of Germany

[73] Assignee: ABB Fläkt AB, Stockholm, Sweden

[21] Appl. No.: 582,989

[22] PCT Filed: Jul. 6, 1994

[86] PCT No.: PCT/EP94/02210

§ 371 Date: Mar. 20, 1996

§ 102(e) Date: Mar. 20, 1996

[87] PCT Pub. No.: WO95/03517

PCT Pub. Date: Feb. 2, 1995

[30] Foreign Application Priority Data

Jul. 21, 1993 [DE] Germany ..... 43 24 488.2

[51] Int. Cl.[6] ..... F26B 3/34

[52] U.S. Cl. ..... 34/271; 34/423; 34/666

[58] Field of Search ..... 34/270, 271, 272, 34/467, 418, 423, 430, 477, 540, 548, 588, 589, 78, 666

[56] References Cited

U.S. PATENT DOCUMENTS

| | | | |
|---|---|---|---|
| 1,110,788 | 9/1914 | Hultgren | 34/78 |
| 2,039,429 | 5/1936 | Lydon | 432/176 |
| 4,493,641 | 1/1985 | Hubbert | 432/120 |
| 4,569,658 | 2/1986 | Wiggins et al. | 34/540 X |
| 4,635,381 | 1/1987 | Hubbert | 34/571 |
| 4,785,552 | 11/1988 | Best | 34/418 |
| 4,907,533 | 3/1990 | Nelson et al. | 34/270 X |
| 4,908,231 | 3/1990 | Nelson et al. | 34/272 X |
| 4,972,606 | 11/1990 | Stoltz | 34/271 |
| 5,363,567 | 11/1994 | Best | 34/271 |

FOREIGN PATENT DOCUMENTS

| | | |
|---|---|---|
| 0067951 | 12/1982 | European Pat. Off. . |
| 0390231 | 10/1990 | European Pat. Off. . |
| 0420554 | 4/1991 | European Pat. Off. . |
| 2417021 | 10/1975 | Germany . |
| 3148321 | 8/1983 | Germany . |
| 3821848 | 2/1989 | Germany . |
| 354027 | 6/1961 | Switzerland . |
| 635437 | 4/1950 | United Kingdom . |

*Primary Examiner*—John M. Sollecito
*Assistant Examiner*—Steve Gravini
*Attorney, Agent, or Firm*—Dilworth & Barrese

[57] ABSTRACT

In a process for drying coated surfaces in a hot-air dryer, part of the hot air in the dryer is continuously circulated therein as a secondary air stream which is mixed with a primary air stream heated to above the drying temperature ($T_{max}$). This reduces the quantity of hot air to be fed into the dryer and thus the material requirements are reduced and the heating time shortened. A hot-dryer for implementing the process has, in the hot-air chambers (7,8) arranged symmetrically on either side in the interior (6) of the dryer, a separating wall (22) dividing an internal chamber (7) and an outer chamber (8) which has fun intake aperture (9) at its lower end for secondary air. At the lower end of the inner chamber (7), the primary air is fed in at a higher flow rate and mixed with the secondary air taken in through the aperture (9).

16 Claims, 3 Drawing Sheets

PROCESS AND HOT-AIR DRYER FOR DYING COATED SURFACES

BACKGROUND OF THE INVENTION

The invention relates to a process for drying coated surfaces and to a hot-air dryer for carrying out this process in which hot air with a drying temperature $T_{max}$ is introduced into the dryer circulated therethrough and removed after appropriate heat transfer for example, to dry surface-coated automobile bodies.

In the field of painting automobile bodies, liquid paints are primarily used. In this case, both application techniques in which the liquid paint is sprayed in a finely atomized manner by means of spray nozzles as well as dip coating processes are used. It is common to these coating processes that in the use of a painting system, a portion of the solvent present in the paint during the coating remains in the applied paint layer. In order to avoid damage to the paint surface as a consequence of a mechanical load, these solvents must be removed or the paint layer must be hardened. For this purpose, dryers are used after the painting process.

The drying of surface-coated automobile bodies are in the most cases in the automobile industry conveyed into special drying tunnels. In this case, the coated automobile body passes through a tunnel-like furnace which is subdivided into different zones/areas in the direction of passage.

In the first area of the dryer, the coated body positioned on a transport means in the interior of the dryer is heated and a portion of the solvent of the applied surface layer is removed (radiation or heating-up zone). In this area, the applied surface layer may not be excessively mechanically loaded because it is not yet completely hardened. For this reason, the energy required to heat up the body and harden the applied surface layer is supplied contactlessly in the form of heat radiation.

One possibility to realize this in technical terms is through application of so-called radiation pockets. These radiation pockets can be heated electrically or by means of hot air streams. In both cases, it is to be taken into account that the surface temperature of the radiation pocket wall facing the object to be dried may not exceed a maximum value ($T_{max}$) because the temperature in the paint coating would otherwise be too high with the result that the surface coating to be dried is damaged. Equally, the surface temperature of the radiation pocket may not fall below a minimum value ($T_{min}$) because the required drying task can otherwise not be fulfilled by the dryer within a predetermined period during which the body remains in the dryer tunnel.

After the heating-up process has taken place in the radiation zone, the body to be dried passes into the second zone, the convection, circulation or holding zone. The body is held at a constant temperature level within the holding zone. During this time, the complete hardening of the paint layer takes place. In order to prevent a cooling-off of the body, heat energy in the form of a hot air stream is supplied to the body in the dryer interior.

A hot-air dryer for drying coated surfaces is known from U.S. Pat. No. 4,493,641 and comprises several area modules arranged successively in the transport direction of the body. These modules are radiation (heating-up) and convection (holding) zone modules or zone modules which can be converted by means of closable inner wall openings from convection into radiation modules. In these known drying zone modules, a partition wall is arranged in such a manner in hot-air chambers laterally surrounding the dryer or module interior such that an outer and an inner chamber is respectively formed. Both of the chambers are respectively connected at their lower end by an opening such that a deflection space is formed. The hot air supplied from above into the outer chamber flows downwardly in this, is deflected and flows upwardly in the inner chamber. In the radiation module (heating-up area), all of the hot air flows upwardly in the inner chamber up to an exhaust air channel provided above the interior space. In the convection module (holding zone), the hot air flows in the inner space at least partially upwardly and also during flow through openings in the inner wall into the dryer interior where it is drawn off at its upper end. In this known dryer, all of the supplied hot air is removed again so that a considerable hot air requirement results. Additionally, the hot air first flows through the outer chamber and then through the inner chamber so that there is already a considerable heat loss before the hot air enters the inner chamber.

The upper temperature limit and the quantity of energy to be transferred to the object to be dried determine the quantity and temperature of the hot air to be supplied to the radiation pocket or the dryer interior. This has the disadvantage for the operator of the dryer that relatively large volumes of hot air must be supplied to the dryer or removed from the dryer by a heat exchanger in the case of indirect heating or by a burner system in the case of direct heating. The possibility to operate with a smaller but more highly tempered quantity of hot air would be more favourable.

SUMMARY OF THE INVENTION

The invention is therefore based on the object of providing a process and a hot-air dryer of the above-mentioned type by means of which the quantity of hot air to be supplied to the dryer is reduced in order to therefore reduce the material requirement for the hot-air channels and blowers and to therefore also shorten the heating-up time of the dryer when starting up the apparatus.

This object is solved by a process of the above-mentioned type including the features of part of the hot air in the dryer being continuously circulated therein as a secondary air stream and a primary air stream heated above the drying temperature $T_{max}$ being mixed with this secondary air stream.

According to this, part of the hot air in the dryer is continuously circulated therein as a secondary air stream, a primary air stream heated to above the maximum allowable drying temperature $T_{max}$ being mixed with this secondary air stream. In this case, it can simultaneously be of advantage if the supplied primary air stream is smaller in terms of volume than the circulating secondary air stream. It is important in this case that the temperature for mixing the primary and secondary air streams is at most equal to the maximum allowable drying temperature $T_{max}$. By means of the inventive process, the quantity of air to be supplied to the dryer is considerably reduced, on account of which, on the one hand, the material requirement for the hot-air channels and blowers is reduced and, on the other hand, the time for heating the dryer upon starting up the apparatus is shortened. As a consequence of the smaller space requirement for the hot-air chambers, the dryer can be reduced in terms of width so that space and material are saved.

The object is additionally solved by a hot-air dryer of the initially mentioned type for carrying out the above-described process and which includes the features of two tunnel-like zones successively arranged in the direction of passage of the coated object, the radiation dryer (radiation zone) and the circulation dryer (convection zone), which respectively have an outer housing and inner walls which form a central interior and two lateral, substantially vertically aligned hot-air chambers arranged symmetrically with respect to the interior.

respectively one separation wall subdividing the hot-air chambers into an inner and outer chamber, which walls have an opening at their lower end which connect the two chambers, and a hot-air stream flowing in the outer chamber from above to below and in the inner chamber from below to above, wherein an apparatus is arranged at the lower end of the inner chamber for introducing with an increased flow velocity a primary air stream heated to above the heating up temperature $T_{max}$, i.e., the maximum allowable drying temperature, and the connecting opening in the partition wall is formed as a suction opening through which at least part of the hot air stream flowing downwardly in the outer chamber is suctioned as a secondary air stream and mixed with the primary air stream to form an "integrated air circulation". Further advantageous embodiments are described in the dependent claims.

Accordingly, an apparatus is arranged at the lower end of the inner chamber to introduce a primary air stream heated above the maximum allowable drying temperature $T_{max}$ with an increased flow velocity. Additionally, the lower connecting opening between both chambers in the partition wall is formed in such a manner as a suction opening that at least part of the hot-air stream flowing downwards in the outer chamber is suctioned as a secondary air stream and mixed with the primary air stream.

In this case, it is of advantage if the suction opening for the secondary air stream and the introducing apparatus for the primary air stream are set up in such a manner that only a relatively small quantity of the overheated primary air stream is mixed with the continuously circulating secondary air stream.

In accordance with the invention, either a nozzle apparatus or a transverse flow ventilator apparatus can be provided as an introducing apparatus, these respectively extending substantially horizontally along the inner hot-air chamber.

In the arrangement with a nozzle apparatus, it is advantageous to provide this in such a manner that the injected primary air stream suctions, conveys and simultaneously mixes with secondary air in the manner of a jet pump. In this case, the nozzle apparatus can have one or more slit nozzles or nozzles with circular, oval or rectangular outlet cross-sections.

In the arrangement with a transverse flow ventilator apparatus as an introducing apparatus, it is advantageous for this to simultaneously suction and mix the primary air stream and the secondary air stream. In order to regulate the quantity ratio of the suctioned primary and secondary air streams, adjustable shutter slats for the outlet air can be provided.

As the successive zones of the dryer, the radiation or holding zone (radiation dryer) and the convection zone (circulation dryer) have different air circulation, it is advantageous if in the former case the inner walls are closed throughout, i.e. impermeable to air, while in the latter case these are respectively designed at the lower end for the air entry and at the upper side for the air discharge into and out of the dryer interior. However, the manner of secondary air circulation together with mixing in of overheated primary air of a smaller volume remains the same in principle.

In the radiation zone, the hot-air chambers are formed by means of the air impermeable inner walls as radiation pockets, the partition walls respectively extending vertically through substantially the entire radiation pockets apart from an upper deflection space and the lower suction opening. In this manner, an inner and an outer radiation pocket chamber are formed which enable a circulation of the hot-air as a continuous circulating secondary air stream through the upper and lower deflection spaces or openings.

The primary air stream of smaller volume is introduced at the lower side of the inner radiation pocket chamber and the radiation pocket exhaust air stream is suctioned off at the lower end of the outer radiation pocket chamber. Consequently, a secondary air stream continuously circulating in the vertical plane moves through the chambers and is supplemented in specific quantity ratios in the inner chamber with overheated primary air and with the same ratio cooled air is withdrawn in the outer chamber.

The radiation property of the radiation pockets is increased even more in that the inner wall has on its surface facing the inner space a coating known per se, the radiation coefficient of which is greater than that of the uncoated radiation pocket material. The efficiency is therefore additionally increased in this manner.

A better mixing and simultaneous increase in heat transfer of the hot air stream formed from the primary and secondary air and rising up in the inner chamber is achieved if turbulence plates are arranged on the side of the inner wall facing away from the interior of the dryer.

In the convection zone (circulation dryer chamber), as previously revealed, arrangements have been made for the passing through of hot-air streams in the lower and upper sections of the inner wall. The partition wall subdividing the hot-air chamber into an inner and an outer chamber only extends in this zone to above the lower through-passage section so that the mixed air stream flowing up in this inner chamber flows through the lower through-passage section into the interior of the dryer and its heat energy is directly transferred by convection to the coated object therein. The air stream cooled in this manner then passes again at the upper through-passage section into the hot-air chamber. At the upper end of the outer chamber, there is provided a dryer exhaust air channel through which part of the cooled hot air flowing into the channel is led away while a further part flows downwards in the outer chamber and at the lower end through the suction opening into the inner chamber and mixes here with the inflowing primary air, following which a new circulation begins.

It is furthermore advantageous if a radiator is arranged in the outer chamber which heats up the suctioned, cooled secondary air stream again. In this manner, the mixed in primary air stream must not be overheated so much or only be of a small volume in order to provide the correct heating up or drying temperature together with the secondary air stream. As a temperature limit for the primary air stream, the condition applies that the mixing temperature of the primary and secondary air stream may not exceed the value $T_{max}$.

BRIEF DESCRIPTION OF THE DRAWINGS

In the following, the invention is explained in more detail by way of exemplary embodiments with reference to the drawings, in which.

DESCRIPTION OF THE PREFERRED EMBODIMENTS

Figure 1:
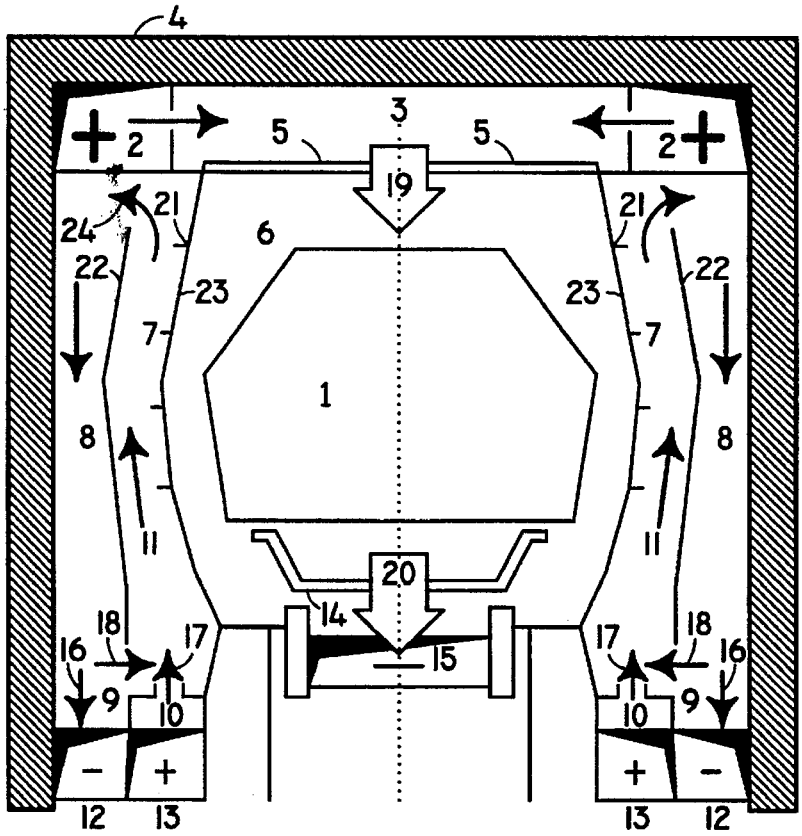
FIG. 1 shows a cross-section through a radiation dryer of a hot-air dryer with an integrated air circulation by means of induction nozzles.
Figure 5:
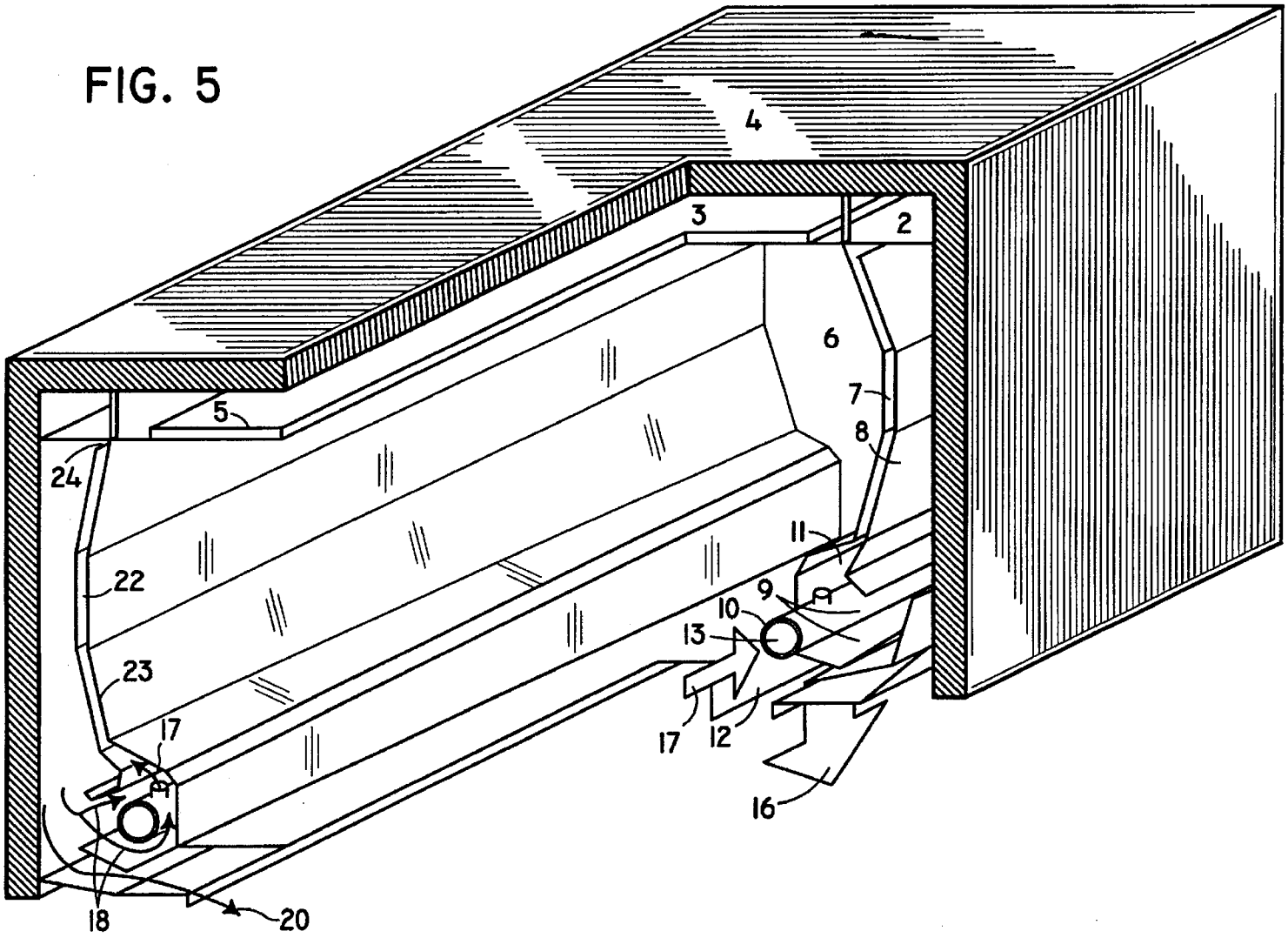
FIG. 5 shows a spatial depiction of a radiation dryer according to FIG. 1.

In FIG. 1, a dryer cross-section is shown with an integrated air circulation or guidance in the radiation pockets of the radiation zone. The radiation pockets respectively consist of two chambers: the chamber A (7) and the chamber B (8). A partition wall 22 is located between the two chambers. Both chambers are connected by means of an upper deflection space 24 and a lower suction opening 9 for the secondary air 18. A primary air stream 17 is guided via an air channel 13 to the radiation pocket A (7) and blown by means of a nozzle apparatus 10 into an injector mixing space 11. The nozzle apparatus extends in this case in the direction of conveyance of the body along the entire radiation pocket length so that an even supply of the primary air or a uniform distribution of the radiation pocket temperature along the entire radiation pocket length is ensured, as is also recognizable in FIG. 5. The primary air stream 17 injected by means of the nozzle apparatus 10 into the chamber A (7) in this case spreads out according to the principles of a free jet and in the manner of a jet pump sucks in secondary air from the radiation pocket chamber B (8) via the suction opening 9. The quantity of sucked in air depends on the flow momentum of the injected hot air. The amount of kinetic energy of the injected air must be large enough so that a sufficient circulation effect in the radiation pockets is guaranteed. The primary air stream 17 and the secondary air stream 18 mix in the injector mixing space 11 to a total air stream and are conveyed by the primary air 17, blown in continuously by means of the nozzle apparatus 10, upwardly and through the radiation pocket in the direction of the radiation pocket outlet air channel 12.

The hot air stream heats up the radiation pocket wall 23 which has a coating, the radiation coefficient of which is greater than that of the uncoated radiation pocket material. In this process, the total air stream is cooled. At the suction opening 9, the secondary air 18 is sucked in again on account of the injector effect of the primary air stream 17. Thus, a circulating secondary air stream 18 in the radiation pocket, i.e. an air stream integrated in the radiation pocket is formed. The primary air stream 17 in this case takes over both the transport of the quantity of heat (the temperature of the primary air stream is decisive) necessary for the heating-up and drying process as well as the transport of the quantity of energy (prepressure of the primary air at the nozzle apparatus) necessary to create the integrated air stream. The nozzle apparatus 10 is in this case capable of being constructed with various modifications. Thus, the use of one or more flat slit nozzles is just as possible as the use of nozzles with circular, oval or rectangular outlet cross-sections.

As may also be seen in FIG. 1, dryer inlet air can be additionally introduced from above as a dryer inlet air stream 19 into the interior space 6 of the dryer from an upper dryer inlet air channel 2 via an expansion space 3 and a filter 5 and withdrawn at the lower side, i.e. beneath the conveying apparatus 14 for the automobile bodies 1 as a dryer exhaust air stream 20 through a dryer exhaust air channel 15.

Figure 2:
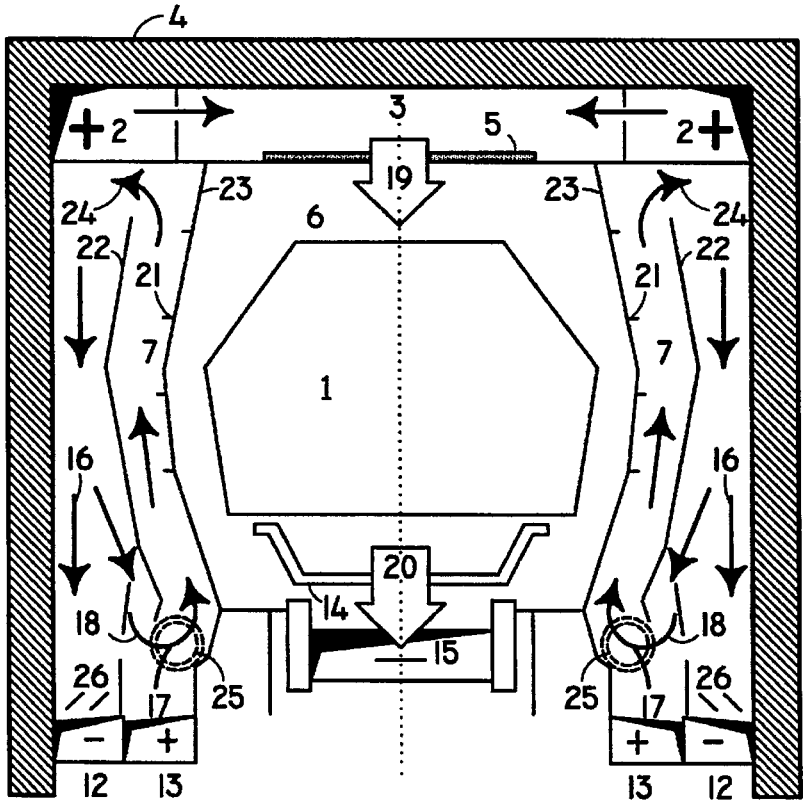
FIG. 2 shows a cross-section through a radiation dryer of a hot-air dryer with an integrated air circulation by means of transverse flow ventilators.

In the exemplary embodiment shown in FIG. 2, the integrated air circulation with transverse flow ventilators 25 is realized. The transverse flow ventilators 25 mounted in the horizontal direction suction both primary as well as secondary air and convey the mixture of both air streams into the radiation pocket chamber A (7). For the supply of the primary air quantity, an air channel 13 is provided beneath the transverse flow ventilators which guarantees a uniform primary air stream along the transverse flow ventilators of the radiation pocket chamber A (7). The quantity ratio of the two air streams is capable of being regulated by means of adjustable shutter slats 26.

Figure 3:
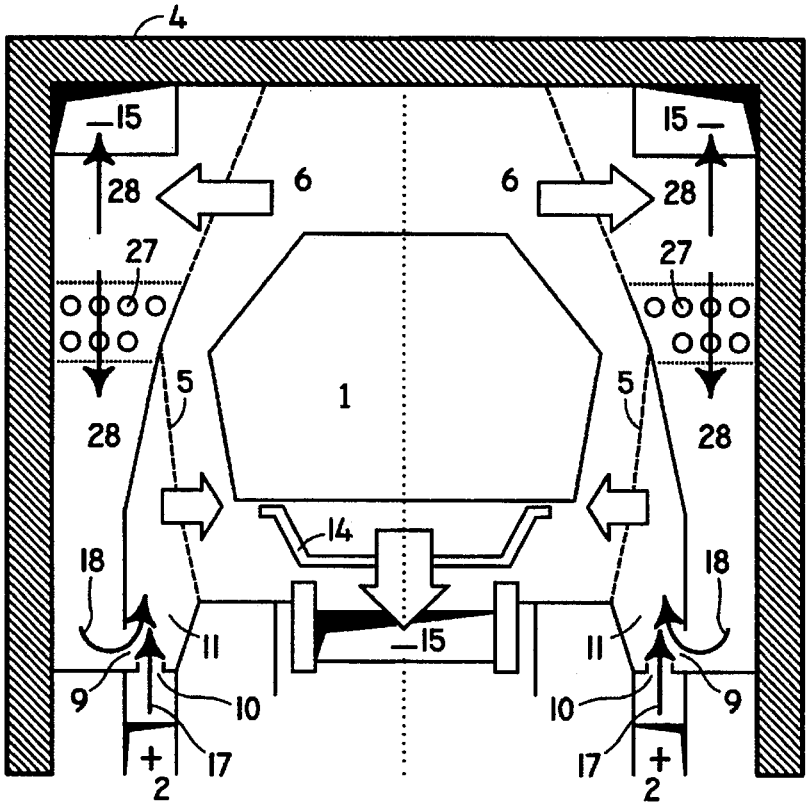
FIG. 3 shows a cross-section through a circulation dryer as in FIG. 1 with an integrated air circulation by means of induction nozzles.

A dryer cross-section with an integrated air circulation in the holding zone (circulation dryer, convection zone) is illustrated in FIG. 3. This dryer module for the holding zone: consists of a dryer interior 6 provided in an outer housing 4 and two laterally arranged circulation chambers 28. The primary air stream 17 is guided by means of air channel 2 to the nozzle apparatus 10 and blown at this location into the injector mixing space 11. The nozzle apparatus extends here in the body conveying direction along the entire holding zone length so that an even supply of the primary air or an even distribution of the temperature is ensured along the entire holding zone. The primary air stream 17 injected by means of the nozzle apparatus 10 into the injector mixing space 11 expands in this case according to the laws of a free jet and sucks in secondary air 18 via the suction opening 9. The quantity of the suctioned secondary air stream 18 depends on the flow momentum of the injected hot air 17. The amount of kinetic energy of the injected air 17 must be large enough so that a sufficient circulation effect in the holding zone is ensured. The primary air stream 17 and the secondary air stream 18 mix in the injector mixing space 11 to a total air stream and are conveyed upwards through the dryer inlet air filter 5 in the direction of the body 1. At this location, the hot air stream gives off its heat energy by means of convection. During this process, the total air stream is cooled. The cooled air is sucked off in the upper region of the holding zone, part of the air being drawn off via an upper exhaust air channel 15. A further part of the exhaust air is suctioned off underneath the body conveying apparatus 14. The remaining air stream is sucked in on account of the injector effect of the primary air stream 17. Thus, a secondary air stream 18 flowing in the holding zone, that is to say an integrated air stream in the holding zone is created. The primary air stream 17 takes over both the supply of the quantity of heat (determining the temperature of the primary air stream) required for compensating heat losses and for the drying process as well as the transport of the quantity of energy (prepressure of the primary air at the nozzle apparatus) required for the creation of the integrated air stream.

Figure 4:
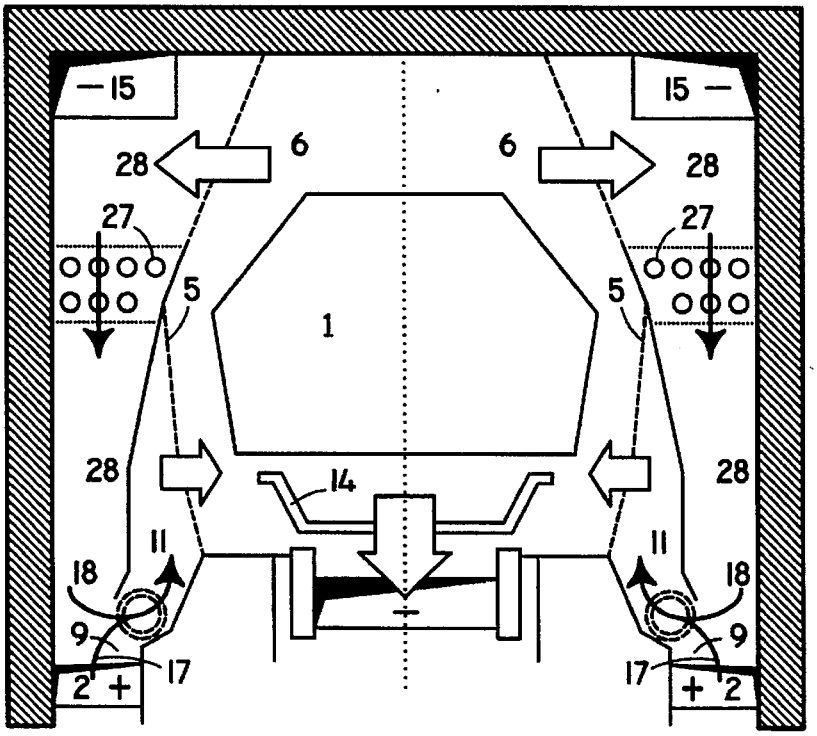
FIG. 4 shows a cross-section through a circulation dryer as in FIG. 2 with an integrated air circulation by means of transverse flow ventilators.

As may be see in FIG. 4, the possibility also exists to realize the integrated air stream in the holding zone with transverse flow ventilators 25. The transverse flow ventilators arranged in the horizontal direction suction both primary as well as secondary air and convey the mixture consisting of both air streams into the interior 6 of the holding zone.

Additionally, a radiator 27 can also be built into the circulation chamber 28 in order to compensate for the heat losses of the secondary air stream 18.

REFERENCE SIGN LIST

1. Workpiece/automobile body
2. dryer inlet air channel
3. expansion space for dryer inlet air
4. outer housing of the dryer
5. filter for the dryer inlet air 6. dryer interior
7. radiation pocket, inner chamber
8. radiation pocket, outer chamber
9. suction opening for secondary air
10. nozzle apparatus for primary air supply
11. injector mixing space
12. radiation pocket exhaust air channel
13. radiation pocket inlet air channel
14. conveyor apparatus for automobile bodies
15. dryer exhaust air channel
16. radiation pocket exhaust air stream
17. primary air stream
18. secondary air stream
19. dryer inlet air stream
20. dryer exhaust air stream
21. turbulence plates
22. partition wall
23. plasma coated radiation pocket outer wall
24. deflection space
25. transverse flow ventilator
26. shutter slats
27. radiator
28. circulation chambers

We claim:

1. A hot-air dryer for carrying out a process for drying coated surfaces in a dryer tunnel space of a hot-air dryer in which hot air with a drying temperature is introduced into the dryer, circulated therethrough and, after appropriate heat transfer, removed again, part of the hot air in the dryer being continuously circulated therein as a secondary air stream (18) and a primary air stream (17) heated above the maximum allowing drying temperature ($T_{max}$) being mixed with this secondary air stream (18), wherein the primary air stream suctions and conveys the secondary air stream with the injection as well as mixing of the primary air and the secondary air ensuing in a chamber separated from the dryer tunnel space, said dryer including two tunnel-like zones successively arranged in the direction of passage of the coated object (1), a radiation dryer (radiation zone) and a circulation dryer (convection zone), which respectively have an outer housing (4) and inner walls (23) which form a central interior (6) and two lateral, substantially vertically aligned hot-air chambers arranged symmetrically with respect to the interior (6), a separation wall (22) respectively subdividing each of the hot-air chambers into an inner and outer chamber (7 and 8), which walls each have an opening (9) at their lower end which connects the two chambers (7, 8), a hot air stream flowing in the outer chamber (8) from above to below and in the inner chamber (7) from below to above, wherein an apparatus (10, 25) is arranged at the lower end of the inner chamber (7) for introducing with an increased flow velocity a primary air stream (17) heated to above the maximum allowable drying temperature ($T_{max}$), the connecting opening in the partition wall (22) is formed as a suction opening (9) through which at least part of the hot air stream flowing downwards in the outer chamber (8) is suctioned as a secondary air stream (18) and mixed with the primary air stream (17) (forming an integrated air circulation).

2. A hot-air dryer according to claim 1, comprising means for providing the mixing temperature of the primary and secondary air streams (17 and 18), at most, equally as high as the maximum allowable drying temperature ($T_{max}$).

3. A hot-air dryer according to claim 1, comprising means for providing the conveyed primary air stream (17) smaller, in terms of volume, than the circulating secondary air stream (18).

4. A hot-air dryer according to claim 1, wherein said apparatus (10, 25) and suction opening (9) constitute means for suctioning and conveying the secondary air stream in the manner of a jet pump.

5. A hot-air dryer according to claim 4, wherein a nozzle apparatus (10) is provided as the introducing apparatus.

6. A hot-air dryer according to claim 5, wherein the nozzle apparatus (10) extends horizontally along the hot-air chamber (7) and is arranged in such a manner that the injected primary air stream (17) suctions secondary air (18) and also conveys the secondary air in the manner of the jet pump.

7. A hot-air dryer according to claim 5, wherein the nozzle apparatus (10) has one or more slit nozzles.

8. A hot-air dryer according to claim 5, wherein the nozzle apparatus (10) has nozzles with circular, oval or rectangular discharge cross-sections.

9. A hot-air dryer according to claim 4, wherein a cross flow ventilator apparatus (25) which simultaneously suctions the primary air (17) and the secondary air (18) is provided as the introducing apparatus.

10. A hot-air dryer according to claim 9, wherein adjustable shutter slats (26) for regulating the ratio of quantities of primary air (17) to secondary air (18) are provided in the outer chamber (8).

11. A hot-air dryer according to claim 4, wherein in the radiation zone (radiation dryer), the inner walls (23) are completely closed and therefore impermeable to air, on account of which the hot-air chambers are formed as radiation pockets, and the respective partition walls (22) essentially extend vertically through the entire radiation pocket chamber (7, 8) to an upper deflection space (24) and the lower suction opening (9) to form an inner and an outer radiation pocket chamber (7, 8), the primary air stream (17) being introduced at the lower side of the inner radiation pocket chamber (7) and the radiation pocket exhaust air stream (16) being suctioned off at the lower end of the outer radiation pocket chamber (8).

12. A hot-air dryer according to claim 11, wherein the inner wall (23) has a coating on its surface facing the interior (6), the radiation coefficient of which is greater than that of the uncoated radiation pocket material.

13. A hot-air dryer according to claim 11, wherein the inner wall (23) has turbulence plates (21) on its surface facing away from the interior (6) which project into the inner chamber (7) .

14. A hot-air dryer according to claim 4, wherein in the convection zone (circulation dryer), the inner wall (23) is arranged for the through-passage of hot air at the lower and upper levels of its extent, the partition wall stops with its upper end at the upper end of the lower through-passage section of the inner wall and forms an inner chamber of a lower height and an outer chamber (28) with substantially the entire hot-air chamber height, and the outer chamber (28) is connected at its upper end with a dryer exhaust air channel.

15. A hot-air dryer according to claim 14, wherein the lower through-passage section is formed between the inner chamber (7) and the dryer interior (6) by a dryer inlet air filter (5).

16. A hot-air dryer according to claim 14, wherein a radiator for heating up the secondary air is arranged in the outer hot-air or circulation chamber (28).

* * * * *

UNITED STATES PATENT AND TRADEMARK OFFICE
CERTIFICATE OF CORRECTION

PATENT NO.: 5,657,555

DATED: August 19, 1997

INVENTOR(S): Dragoslav Milojevic and Manfred Lösch

It is certified that error appears in the above-identified patent and that said Letters Patent is hereby corrected as shown below:

Title page, and col. 1,
Item [54], CHANGE "DYING" TO --DRYING--.

Signed and Sealed this

Nineteenth Day of May, 1998

Bruce Lehman

*Attest:*

BRUCE LEHMAN

*Attesting Officer*

*Commissioner of Patents and Trademarks*